US005775657A

United States Patent [19]

Hung

[11] Patent Number: 5,775,657

[45] Date of Patent: Jul. 7, 1998

[54] COMPUTER KEYBOARD SUPPORT WITH ANGLE ADJUSTABLE AT RANDOM

[76] Inventor: Chin-Jui Hung, No. 498-3, Chung Shan Rd., Ching Shui Chen, Taichung Hsien, Taiwan

[21] Appl. No.: 671,644

[22] Filed: Jun. 28, 1996

[51] Int. Cl.[6] ..... A47F 5/00

[52] U.S. Cl. ..... 248/289.11; 248/279.1; 248/918

[58] Field of Search ..... 248/281.11, 278.1, 248/279.1, 291.11, 289.11, 299.1, 918, 919, 118.3, 118.5; 312/223.2, 223.3, 27, 28; 108/69, 75, 140, 145, 2, 10

[56] References Cited

U.S. PATENT DOCUMENTS

| | | | |
|---|---|---|---|
| 4,616,798 | 10/1986 | Smeenge et al. | 248/281.1 |
| 4,706,919 | 11/1987 | Soberalski et al. | 248/281.1 |
| 4,708,312 | 11/1987 | Rohr | 248/280.1 |
| 5,037,054 | 8/1991 | McConnell | 248/284 |
| 5,211,367 | 5/1993 | Musculus | 248/279 |
| 5,230,289 | 7/1993 | George et al. | 108/2 |
| 5,257,767 | 11/1993 | McConnell | 248/284 |

*Primary Examiner*—Leslie A. Braun
*Assistant Examiner*—Gwendolyn W. Baxter
*Attorney, Agent, or Firm*—Bacon & Thomas

[57] ABSTRACT

The present invention relates to a computer keyboard support with angle adjustable at random, mounted under a common desk and table, and available for reception, withdrawal, adjustment of vertical height and angle, horizontal angle, keyboard angle, and including a safety device to prevent error release, suitable for various conditions of use, comprising a retaining plate, slide plate, rotary disk, rail, fixing seat, main seat, packing blocks, adjustment arm, keyboard plate seat, loose-proof spring, sleeve, link bar, wrench clutch control spring, connection bolt: slide plate and rotary disk which are slidable for reception or withdrawal for use and are rotable at left and right angle; the angle of main seat and adjustment arm, and angle of adjustment arm and keyboard plate seat adjustable by means of locking bolt, packing blocks, adjustment arm, keyboard plate seat and wrench; release and drop prevented during the process of angle adjustment by means of loose-proof spring; angle change by error touch of wrench prevented by means of clutch spring.

3 Claims, 6 Drawing Sheets

COMPUTER KEYBOARD SUPPORT WITH ANGLE ADJUSTABLE AT RANDOM

BACKGROUND OF THE INVENTION

The present invention relates to an auxiliary support for computer keyboard, and particularly to a computer keyboard support with angle adjustable at random which is convenient for the placement of keyboard with angle adjustable as desired at random when the computer is placed on a common table plate or desk (not the desk specially designed for the computer).

Generally speaking the computer set and its keyboard are placed on a computer desk and the keyboard is placed on an extensible plate. It is comprehensible that the aforesaid way should require a computer desk for use. However, if there were not a computer desk for use (such as a common desk, work table), the keyboard in most cases has to be placed on the desk or table and this can not store it well to avoid touch by mistake and can not offer the optimal height and angle to comply with human body engineering; therefore there has an additional support for placing the keyboard and it is a means of "clamping on the edge of desk", comprising two parallel bars with variable width on both ends in parallel, and on the bottom end having a type clip, bolt for clamping on the desk edge to form like "bending desk lamp" skeleton, and obviously it is not a complete design for matching the desk/table, and further it is much limited and complicated with respect to the angle, positioning and weight loading of "two parallel bars" bending structures and still further it can not allow for extension under the bottom of desk/table.

In view of the defects and shortcomings found in the conventional arts, the present invention is therefore intended to break through the mode of the conventional arts such as: (1) allowing the computer keyboard for placing on an integral design with a common desk (such as OA desk), work table (2) suitable for a common desk, work table (3) multi-angle adjustable to fit various conditions of use and height and angle of user according to human body engineering (4) allowing for reception, withdrawal entirely resembling a computer desk (5) prevention of touch by mistake (6) for bearing larger weight while to provide a multifunctional and practical support for loading computer keyboard as the main purpose of the present invention.

These and other objects and advantages of the present invention will become apparent to those skilled in art after considering the following detailed specification together with the accompanying drawings.

DETAILED DESCRIPTION OF THE PREFERRED EMBODIMENT

Figure 1A:
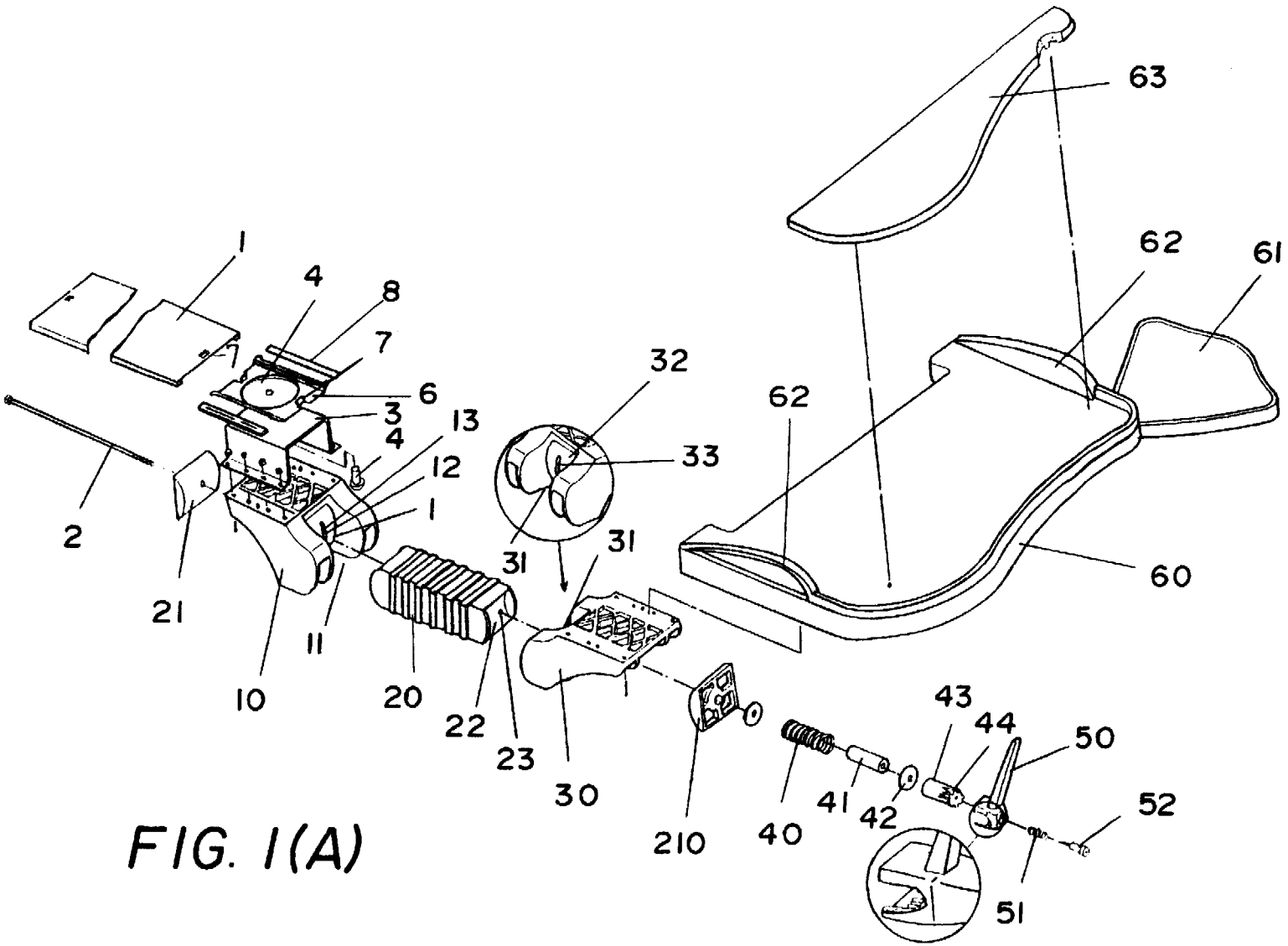
FIG. 1A is an elevational-sectional view of the present invention.
Figure 1B:
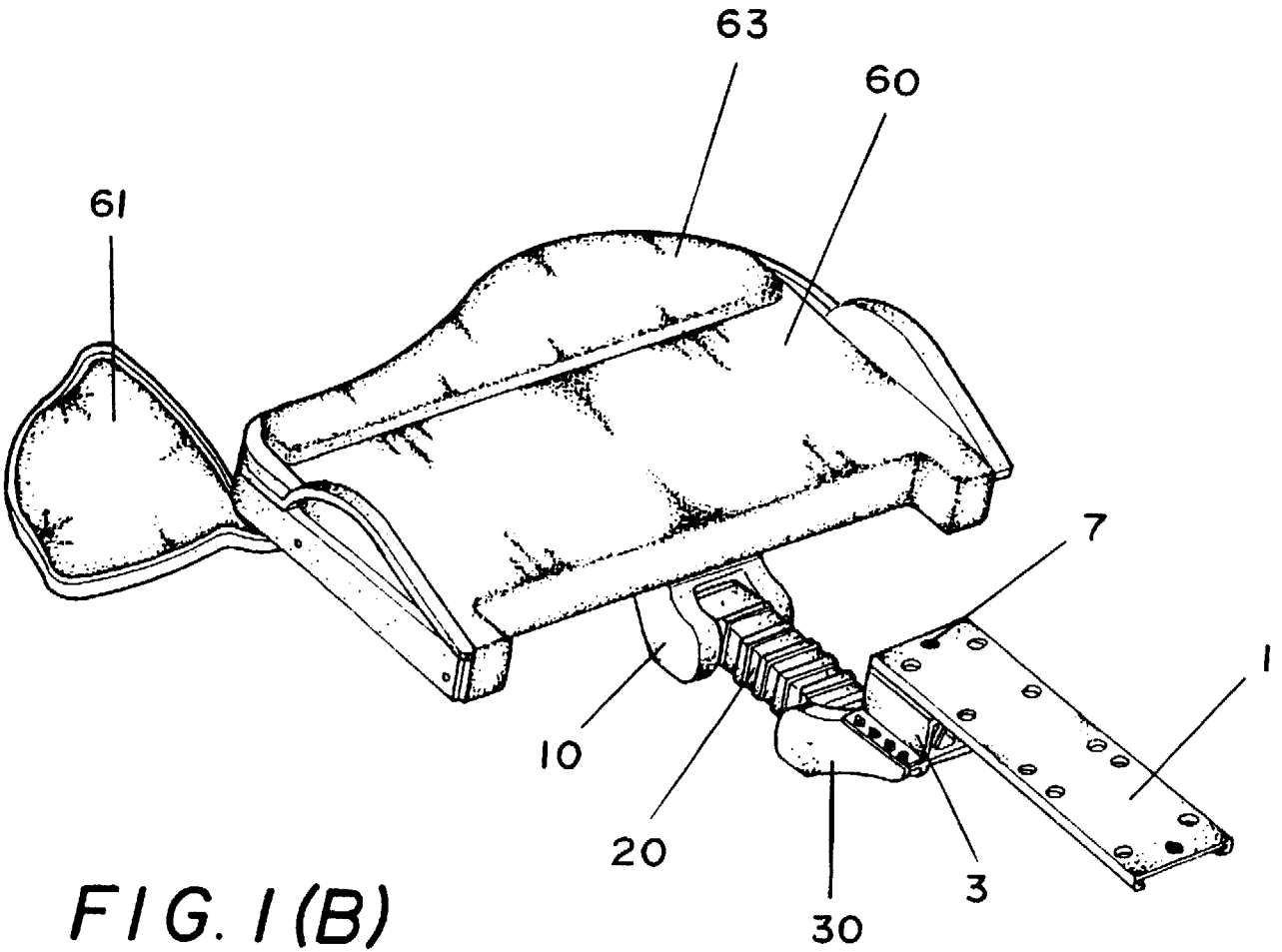
FIG. 1B is an elevational-assembly view showing the outlook of the present invention.
Figure 2:
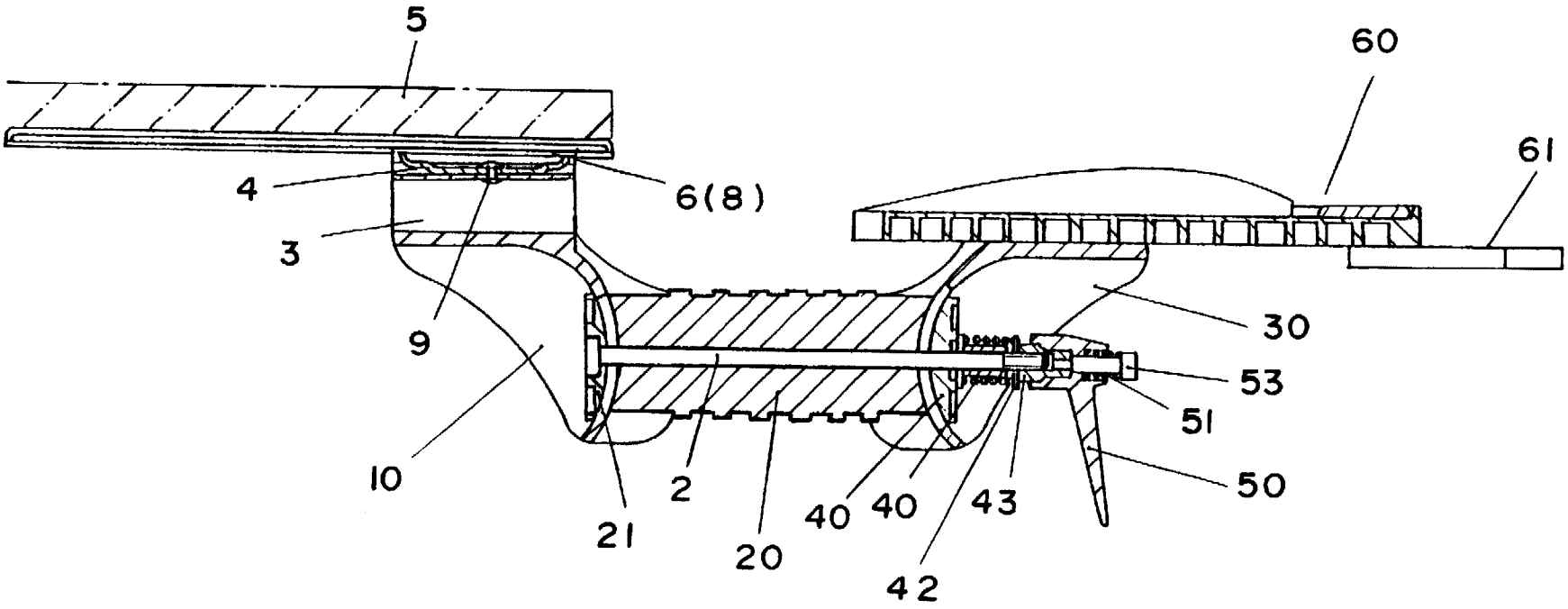
FIG. 2 is an assembly-perspective view of the present invention.

Referring to FIGS. 1A, 1B and 2, the present invention comprises a retaining plate 1, locking bolt 2, fixing seat 3, slide plate 6, rotary disk 4, main seat 10, adjustment arm 20, keyboard plate seat 30, packing blocks 21, 210, loose-proof spring 40, linking bar 43, wrench 50, clutch control spring 51, keyboard plate 60, wherein:

said retaining plate 1 having locating projection 7 on the front and rear ends and fixed to the bottom of table plate 5; said slide plate 6 also having locating projection 7 on the front and rear ends, and having rail 8 on each side for fitting in the retaining plate 1 to permit for sliding back and forth; the bottom of said fixing seat 3 integrally connected with the main seat 10, and the top integrally assembled with the mandrel 9, rotary disk 4 and slide plate 6 for rotable along the mandrel 9;

said main seat 10 having a recess 11 on the end, and the bottom of said recess 11 resembling an arc projection 12 and having a through adjustment slot 13, said keyboard plate seat 30 also having a recess 31, arc projection 32 and through adjustment slot 13 on the end; both ends of said adjustment arm 20 resembling a recessive arc 22 corresponding to said arc projections 12, 32, and having through hole 23 for fitting in the main seat 10 and keyboard plate seat 30 and integrally connected by the locking bolt 2, and packing blocks 21, 210 mounted on the other end of main seat 10 and keyboard plate seat 30 forcibly pushing the main seat 10, keyboard plate seat 30 and adjustment arm 20 when locking bolt 2 screwed up;

said loose-proof spring 40, sleeve 40, and said sleeve 40 having locking bolt 2 penetrated therethrough, and the end of said locking bolt 2 having a link bar 43 with clutch tooth 44: and a thrust sheet 42 located between said sleeve 41 and link bar 43 to provide as supporting point for loose-proof spring 40 so that said locking bolt 2 may produce tight pushing result to form a loose-proof device;

said wrench 50 including a pin 52 corresponding to the clutch tooth 44 of link bar 43, and fitting to said link bar 43, and having clutch control spring 51, and connecting said link bar 43 by matching a connection bolt 53, and said wrench 50 slidable up and down along said link bar so that the pin 52 may be engaged and disengaged with said clutch tooth 44;

said keyboard plate 60 mounted on said keyboard plate seat 30, having a mouse plate 61 on the bottom side, and both sides having limit wall 62 to prevent the keyboard from sliding out, and the front end having dismountable supplement plate 63;

The advantages of the present invention are described as follows:

1. Reception and withdrawal

Figure 3A:
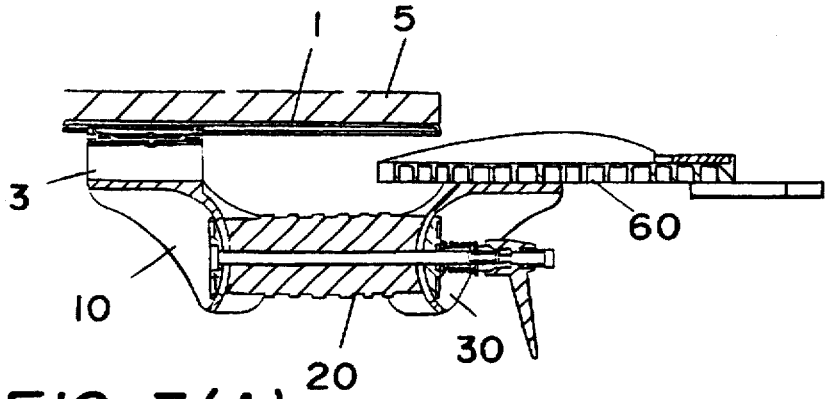
FIG. 3A, 3B, 3C and 3D are a schematic drawing showing the adjustment of angle of the present invention.

Referring to FIG. 3A and FIG. 1A, when not for use, the slide plate 6 and the whole unit are located at the utmost rear end of retaining plate 1 so as to receive the whole unit on the rear end without occupying space and to store the keyboard under the table plate 5; when intended for use, the keyboard can be withdrawn and the slide plate 6 may match the rail 8 for moving forward along the retaining plate 1 and accordingly the fixing seat 3 and main seat 10 may be withdrawn too to permit the user for use. Another, the slide plate 6 and locating projections 7 of retaining plate 1 may produce mutual-stop result to prevent the slide plate 6 from error breaking away.

2. Adjustable angle and height of main seat 10 and adjustment arm 20

Figure 3B:
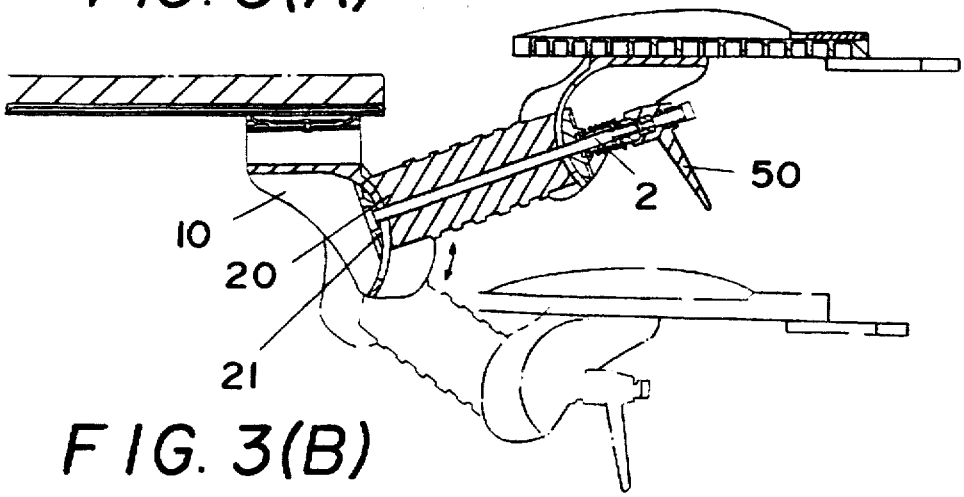

Referring to FIG. 3B, FIG. 1A and FIG. 2, slightly release the locking bolt 2, and arc recess 22 of adjustment arm 20 may be moving up or down along the arc projection 12 and adjustment slot 13 of main seat 10 and then screw up the locking bolt 2 until the angle is adjusted as desired. i.e. when the adjustment arm 20 is adjusted upward a higher height may be obtained, and lower height may be obtained if adjusted downward so as to fit the height of use's height, chair height or personal customary height to comply with human body engineering.

3. Adjustable angle of adjustment arm 20 and keyboard plate seat 30

Figure 3C:
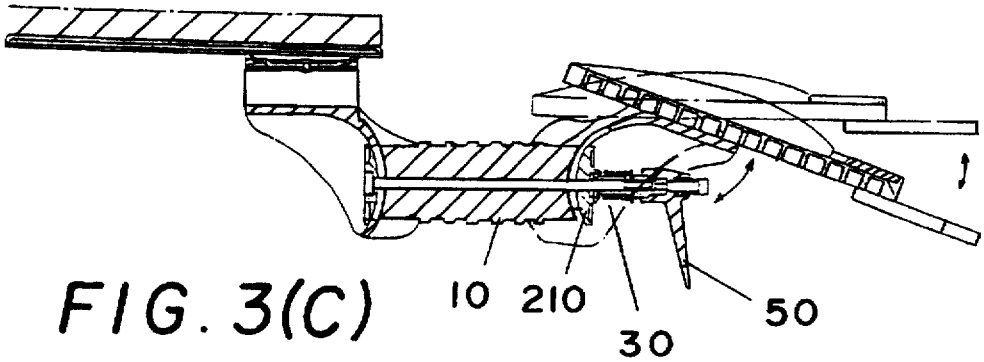
Figure 3D:
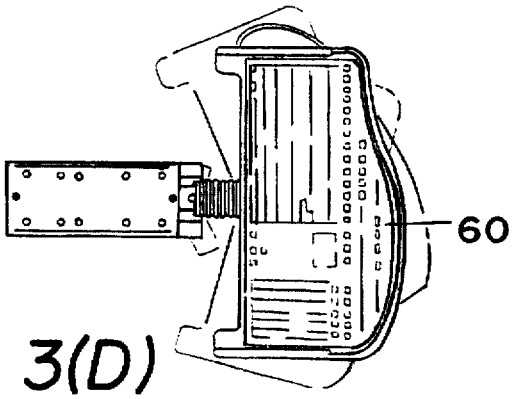

Referring to FIG. 3C. FIG. 1A and FIG. 2, slightly release the locking bolt 2, the arc projection 32 of keyboard plate seat 30 as well as adjustment slot 33 may be moving along the recessive art 22 of adjustment arm 20, and then screw up the locking bolt 2 until the angle is adjusted as desired and the keyboard may have the optimal and most comfortable angle for the user to operate to comply with human body engineering.

4. Prevent error sudden drop during the process of adjustment

Referring to FIG. 2, the thrust force of loose-proof spring 40 to match the thrust sheet 42 and packing blocks 21, 210 may force the locking bolt 2 to be pulled tightly from time to time, i.e. the locking bolt 2 may cause the main seat. 10, adjustment arm 20 and keyboard plate seat 30 to be integrally pulled tight so that the locking bolt 2 will not be released too much (because the weight of keyboard may cause the adjustment arm 10 or keyboard plate seat 30 moving slightly and the user may know it is adjustable and will not release the locking bolt 2 any more) during the process of angle adjustment by the user so as to prevent overall sudden drop, i.e. the loose-proof spring 40 may increase the frictional force on the arc projection and arc recess to give a "slow drop" result.

5. Prevent error release as a result of touching wrench by mistake

Figure 4A:
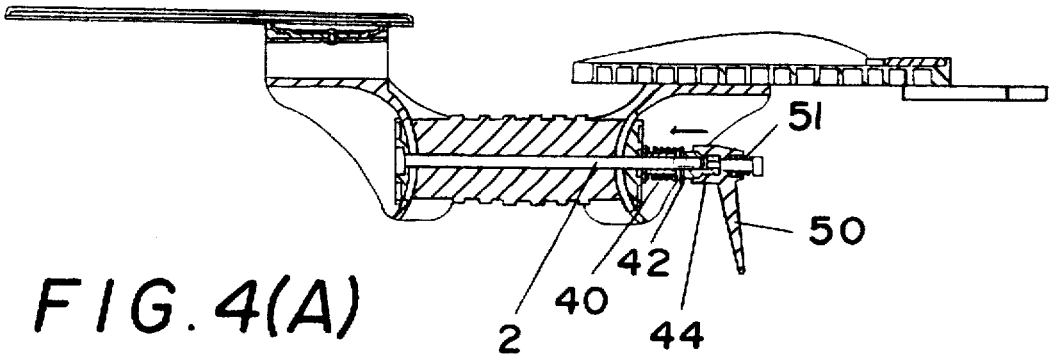
FIG. 4A is a schematic drawing showing the locking bolt and wrench screwing up.
Figure 4B:
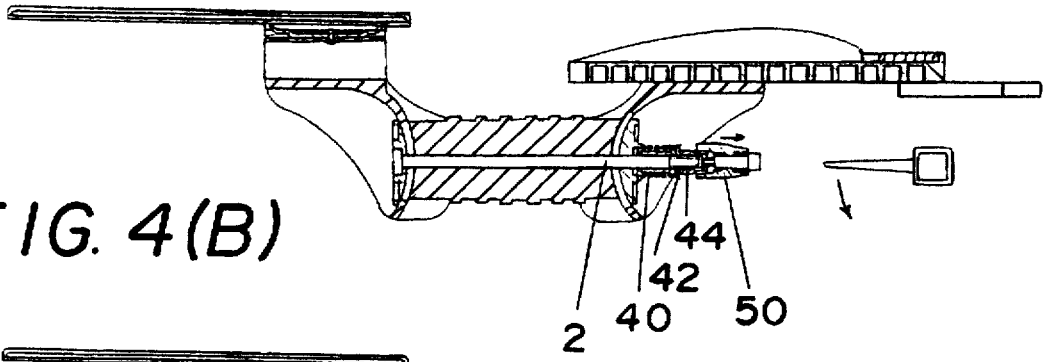
FIG. 4B a schematic view showing idle run of locking bolt and wrench and FIG. 4C a schematic view showing the release of locking bolt and wrench of the present invention.
Figure 4C:
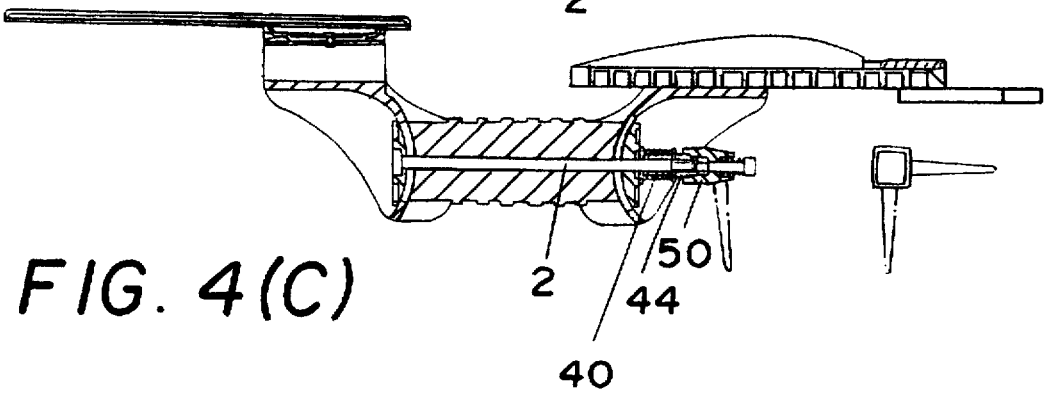

Referring to FIG. 4 and FIG. 1A (wrench 51 and link bar 43), when not for angle adjustment, with the function of clutch spring 51 the wrench 50 may appear much projecting position (FIG. 4B), i.e. the pin 52 of wrench 50 is not gearing into the clutch tooth 44 of link bar 43 and the wrench 50 may appear idle run without linking up the link bar 43 so that even if the wrench 50 is touched by mistake, the locking bolt 2 will not be caused to rotation so as to prevent error action by mistake.

When screwing up (FIG. 4A) or release adjustment (FIG. 4C) is desired, push down the wrench toward the locking bolt 2 for simultaneous rotation whereby the pin 52 may gear into the clutch tooth 44 of link bar 43 to cause the link bar 43 in rotation and further to cause the locking bolt 2 in rotation whereby the locking bolt 2 can be screwed up or released. The wrench 50 of the present invention which has safety protection design may attain practical result.

6. Adjustable left and right angles as a whole

Referring to FIG. 3C, FIG. 1A and FIG.2 (rotary disk 4 and mandrel 9), when to match sitting is desired or a temporary need to push the keyboard aside for working on the table, only need to push the whole unit to the left or the right and the whole unit may be deflected by means of the mandrel 9 and rotary disk 4 to give the effect of flat angle adjustment, and when the keyboard is not intended for use, said keyboard plate 60 can be entirely received under the table to save space.

7. Keyboard plate 60 adaptable to various kinds of keyboard

Figure 5A:
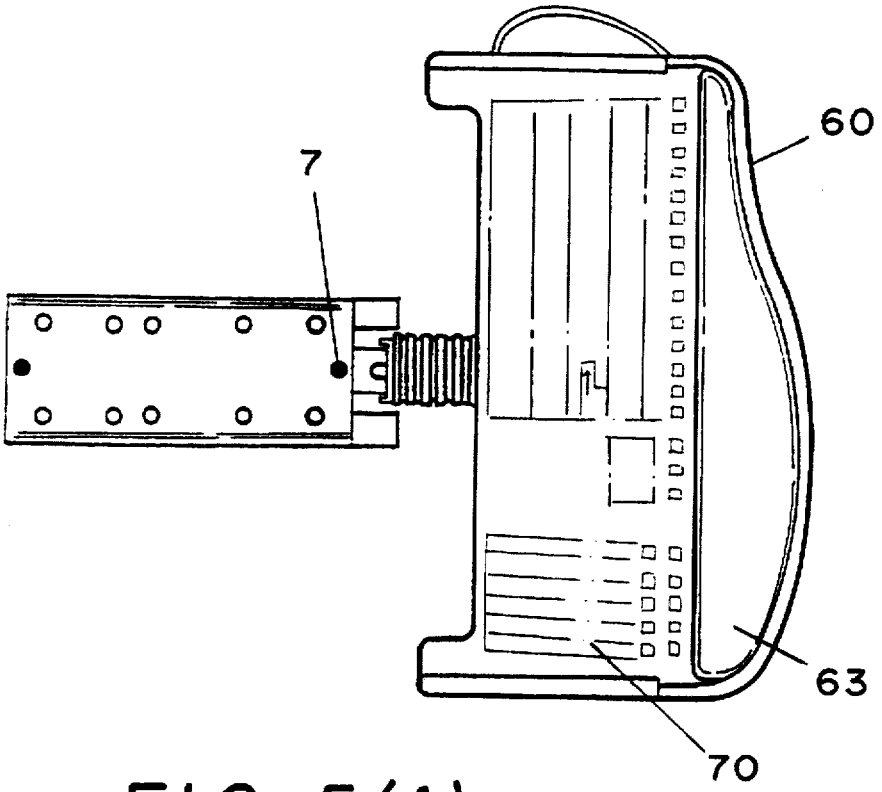
FIG. 5A and 5B are a schematic drawing showing the embodiment of the keyboard plate of the present invention.
Figure 5B:
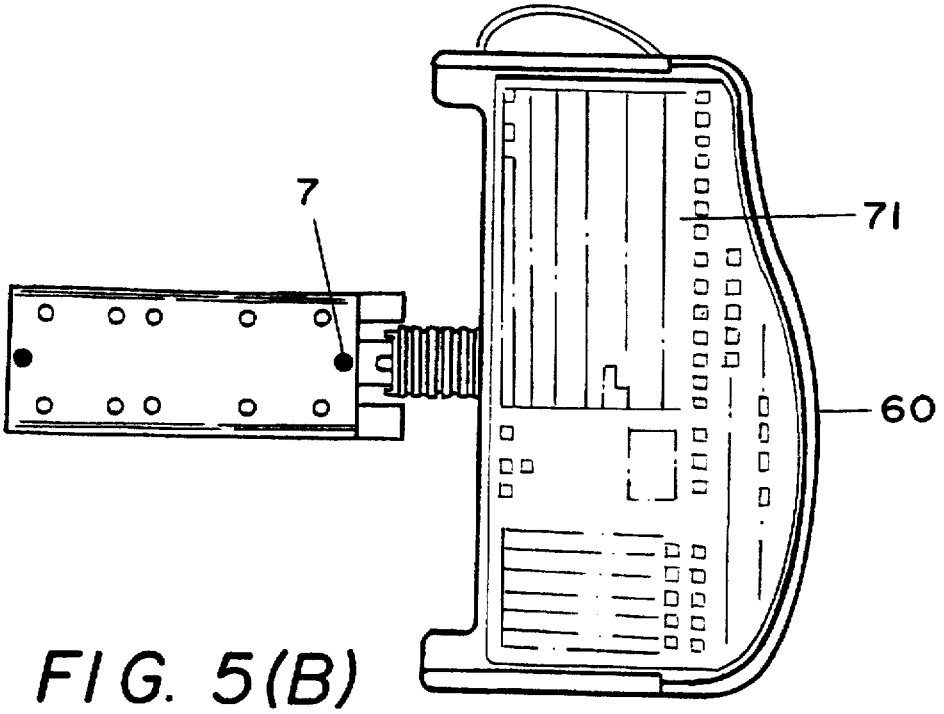

Referring to FIG. 5, the supplement plate 63 to the keyboard plate 60 of the present invention may be dismountable or assembled subject to the need. i.e. when a rectangular keyboard 70 is in use (FIG. 5A), the supplement plate 63 is mounted on the front end of keyboard plate 60 to limit the keyboard in conjunction wt the limit wall 62 on both sides to prevent it from sliding out. Further, the thickness of said supplement plate 63 is the same as the thickness of the keyboard, which may provide as the support height to the hand to comply with human body engineering; when a special curve keyboard 71 is intended for use, the supplement plate (FIG. 5B) may be dismounted to increase the area of keyboard plate 60 so as to adapt to various types of keyboard.

What is claimed is:

1. An adjustable computer keyboard support comprising a retaining plate, locking bolt, fixing seat, slide plate, rotary disk, main seat, adjustment arm, keyboard plate seat, packing blocks, loose-proof spring, linking bar, wrench, clutch control spring, keyboard plate, wherein:

said retaining plate has first locating projections on front and rear ends and fixed to the bottom of a table plate; said slide plate has second locating projections on front and rear ends, and a rail on each side for fitting in the retaining plate enabling sliding back and forth; a bottom of said fixing seat integrally connected with a main seat, and a top integrally assembled with a mandrel, said rotary disk and slide plate rotable along the mandrel;

said main seat having a first recess on an end, a bottom of said recess being an arcuate projection having a through adjustment slot, said keyboard plate seat having a second recess, arcuate projection and through adjustment slot on an end; ends of said adjustment arm having a recessed arc corresponding to said arcuate projections, and having through holes engaged by the main seat and keyboard plate seat and integrally connected by the locking bolt, and packing blocks mounted on the main seat and keyboard plate seat forcibly pushing the main seat, keyboard plate seat and adjustment arm when the locking bolt is tightened;

said loose-proof spring and a sleeve having said locking bolt penetrated therethrough, and the end of said locking bolt having a link bar with clutch tooth; and a thrust sheet located between said sleeve and link bar to provide a supporting point for said loose-proof spring so that said locking bolt produces a tight pushing force to form a loose-proof device; and said wrench including a pin corresponding to the clutch tooth of said link bar, and fitting into said link bar, and having a clutch control spring, and connecting said link bar by matching a connection bolt, said wrench slidable along said link bar so that the pin may be engaged and disengaged with said clutch tooth.

2. The computer keyboard support as claimed in claim 1, said keyboard plate mounted on said keyboard plate seat, having a mouse plate on the bottom side, and both sides having limit wall to prevent a computer keyboard from sliding out, and the front end having dismountable supplement plate for adaptable to various types of keyboard.

3. The computer keyboard support as claimed in claim 2, further comprising a supplement plate mounted on a front end of said keyboard plate to provide a support to hands of a user.

* * * * *